US007293376B2

(12) United States Patent
Glover

(10) Patent No.: US 7,293,376 B2
(45) Date of Patent: Nov. 13, 2007

(54) GRADING CONTROL SYSTEM

(75) Inventor: Clarence Matthew Glover, Washington, IL (US)

(73) Assignee: Caterpillar Inc., Peoria, IL (US)

( * ) Notice: Subject to any disclaimer, the term of this patent is extended or adjusted under 35 U.S.C. 154(b) by 0 days.

(21) Appl. No.: 10/994,233

(22) Filed: Nov. 23, 2004

(65) Prior Publication Data

US 2006/0123673 A1 Jun. 15, 2006

(51) Int. Cl.
*E02F 3/04* (2006.01)

(52) U.S. Cl. ..... 37/414; 37/415; 172/2; 701/50

(58) Field of Classification Search ..... 172/2; 37/414–416, 348, 382; 701/50
See application file for complete search history.

(56) References Cited

U.S. PATENT DOCUMENTS 4,129,224 A 12/1978 Teach
4,231,700 A 11/1980 Studebaker
4,244,123 A * 1/1981 Lazure et al. ..... 37/348
4,273,196 A * 6/1981 Etsusaki et al. ..... 172/4.5
4,282,933 A * 8/1981 Suganami et al. ..... 172/4.5
4,403,889 A 9/1983 Gillotti
4,769,700 A 9/1988 Pryor
4,805,086 A 2/1989 Nielsen et al.
4,807,131 A * 2/1989 Clegg ..... 701/50
4,829,418 A 5/1989 Nielsen et al.
4,833,615 A 5/1989 Bitner et al.
4,866,641 A 9/1989 Nielsen et al.
4,888,890 A 12/1989 Studebaker et al.
4,945,221 A 7/1990 Nielsen et al.
5,005,652 A * 4/1991 Johnson ..... 172/1
5,174,385 A * 12/1992 Shinbo et al. ..... 172/4.5
5,461,803 A 10/1995 Rocke
5,462,125 A 10/1995 Stratton et al.
5,467,541 A 11/1995 Greer et al.
5,467,829 A 11/1995 Barton et al.
5,493,798 A * 2/1996 Rocke et al. ..... 37/348
5,499,684 A 3/1996 Stratton
5,551,518 A 9/1996 Stratton
5,560,431 A 10/1996 Stratton
5,612,864 A 3/1997 Henderson (Continued)

FOREIGN PATENT DOCUMENTS

EP 0 731 221 A1 9/1996

(Continued)

*Primary Examiner*—Thomas A Beach
(74) *Attorney, Agent, or Firm*—Finnegan, Henderson, Farabow, Garrett & Dunner

(57) ABSTRACT

A grading control system for a work machine having a work implement for grading along a grade defined by a laser plane generator is disclosed. The system includes tilt and lift actuators associated with the work implement and configured to selectively tilt, raise and lower the work implement. A laser receiver is configured to receive a laser signal indicative of a desired grade. The laser receiver is configured to communicate a height signal indicative of a position of the work machine relative to the laser plane. A lift sensor is configured to communicate a lift signal indicative of a lift position of the work implement. A control module is configured to generate and communicate a control signal based on the height and lift signals to actuate at least one of the lift and tilt actuators to maintain the work implement at a position substantially corresponding to the desired grade.

26 Claims, 3 Drawing Sheets

U.S. PATENT DOCUMENTS 5,647,439 A 7/1997 Burdick et al.
5,649,600 A 7/1997 Marsh
5,731,761 A 3/1998 Sychra
5,764,511 A 6/1998 Henderson
5,771,978 A 6/1998 Davidson et al.
5,848,485 A * 12/1998 Anderson et al. ..... 37/348
5,852,493 A 12/1998 Monnin
5,854,988 A * 12/1998 Davidson et al. ..... 701/50
5,880,681 A 3/1999 Codina et al.
5,905,968 A 5/1999 Staub et al.
5,925,085 A 7/1999 Kleimenhagen et al.
5,935,183 A 8/1999 Sahm et al.
5,951,612 A 9/1999 Sahm
5,987,371 A 11/1999 Bailey et al.
6,028,524 A 2/2000 Hartman et al.
6,076,029 A * 6/2000 Watanabe et al. ..... 701/50
6,129,156 A 10/2000 Boast et al.
6,209,232 B1 4/2001 Ono et al.
6,253,136 B1 6/2001 Stratton et al.
6,263,595 B1 7/2001 Ake
6,418,364 B1 7/2002 Kalafut et al.
6,453,227 B1 9/2002 Kalafut et al.
6,604,305 B2 8/2003 Koch
6,609,315 B1 * 8/2003 Hendron et al. ..... 37/348
6,655,465 B2 12/2003 Carlson et al.
6,691,437 B1 2/2004 Yost et al.
6,736,216 B2 5/2004 Savard et al.

FOREIGN PATENT DOCUMENTS

EP 0731221 9/1996
JP 3295935 12/1991
JP 4353126 12/1992
JP 8-308309 11/1996

* cited by examiner

GRADING CONTROL SYSTEM

TECHNICAL FIELD

This disclosure is directed to a work machine, and more particularly, to a system and method for grading using a work machine.

BACKGROUND

Worksite preparations often include grading a worksite to form a specific, desired slope. Conventional grading may require that multiple grading stakes be placed about the worksite as reference points to ensure that the correct amount of material is removed or added to form the desired grade. The accuracy of the grade slope, however, may be dependent upon the number of grade stakes used and the distance between each grade stake. As the distance between stakes increases, the error in the grade slope may also increase. Accordingly, to minimize error in the grade slope, surveyors place stakes a limited distance apart. Depending on the worksite, stake placement may be a lengthy and tedious process. Further, during the actual grading, additional personnel often are needed to monitor the grade to ensure that the grade is within acceptable limits.

One known system for increasing accuracy of the grade slope without increasing the number of grade stakes uses a laser plane as a reference point, instead of the grade stakes. The laser plane may be emitted over the worksite so that it is parallel to the desired grade. During grading, a work machine may reference the laser plane while excavating the ground or earth in order to create the desired grade.

One laser system is disclosed in U.S. Pat. No. 5,951,613 to Sahm et al. The system disclosed in the '613 patent includes an apparatus for determining the position of a motor grader in a site coordinate system. This system uses a controller, GPS receivers, and several sensors to determine the position of the motor grader in the site coordinate system.

Another system includes a laser plane detecting system for use on a bulldozer type tractor for pushing earth material to grade a worksite. The laser plane detecting system may include a mast attached to the bulldozer blade that detects the position of the laser plane. The laser mast may be associated with the blade in a manner to control the blade so that the mast tracks the laser plane, thereby causing the blade to track the desired grade.

While these known systems are useful for some large excavations, they may be impractical for smaller jobs. For example, some grading may be performed in areas having limited access or that are too small for large work machines. Motor graders and track-type bulldozer tractors may be unwieldy and/or uneconomical to operate at these worksites. In addition, the known systems include a laser mast attached to the blade. Therefore, the systems may be incapable of determining the position of the blade relative to the work machine.

The systems and methods for grading disclosed herein overcome one or more of the shortcomings of conventional systems.

SUMMARY OF THE INVENTION

In one exemplary aspect, a grading control system for a work machine having a work implement for grading along a grade defined by a laser plane generator is disclosed. The system includes a tilt actuator associated with the work implement and configured to tilt the work implement and a lift actuator associated with the work implement and configured to selectively raise and lower the work implement. A laser receiver is configured to receive a laser signal from the laser plane generator indicative of a desired grade. The laser receiver is configured to communicate a height signal based on the laser signal. The height signal may be indicative of a position of the work machine or work implement relative to the laser plane. A lift sensor is configured to communicate a lift signal indicative of a lift position of the work implement. A control module is in communication with the laser receiver and the lift sensor and is configured to generate a control signal based on the height signal and the lift signal. The control module is also configured to communicate the control signal to actuate at least one of the lift and tilt actuators to maintain the work implement at a position substantially corresponding to the desired grade.

In another exemplary aspect, a method of grading using a work machine having a work implement for grading along a grade defined by a laser plane generator is disclosed. The method includes generating a laser plane indicative of a desired grade and detecting the laser plane at a laser receiver. A height signal is communicated based on the laser plane from the laser receiver. The height signal may be indicative of a position of the work machine relative to the laser plane. A lift signal is communicated indicative of a lift position of the work implement with a lift sensor. A control signal is generated with a control module, the control signal being based on the height signal and the lift signal. The control signal is communicated to at least one of a lift actuator and a tilt actuator to maintain a position of the work implement at a desired height relative to the desired grade.

DETAILED DESCRIPTION

Reference will now be made in detail to exemplary embodiments, examples of which are illustrated in the accompanying drawings. Wherever possible, the same reference numbers will be used throughout the drawings to refer to the same or like parts.

Figure 1:
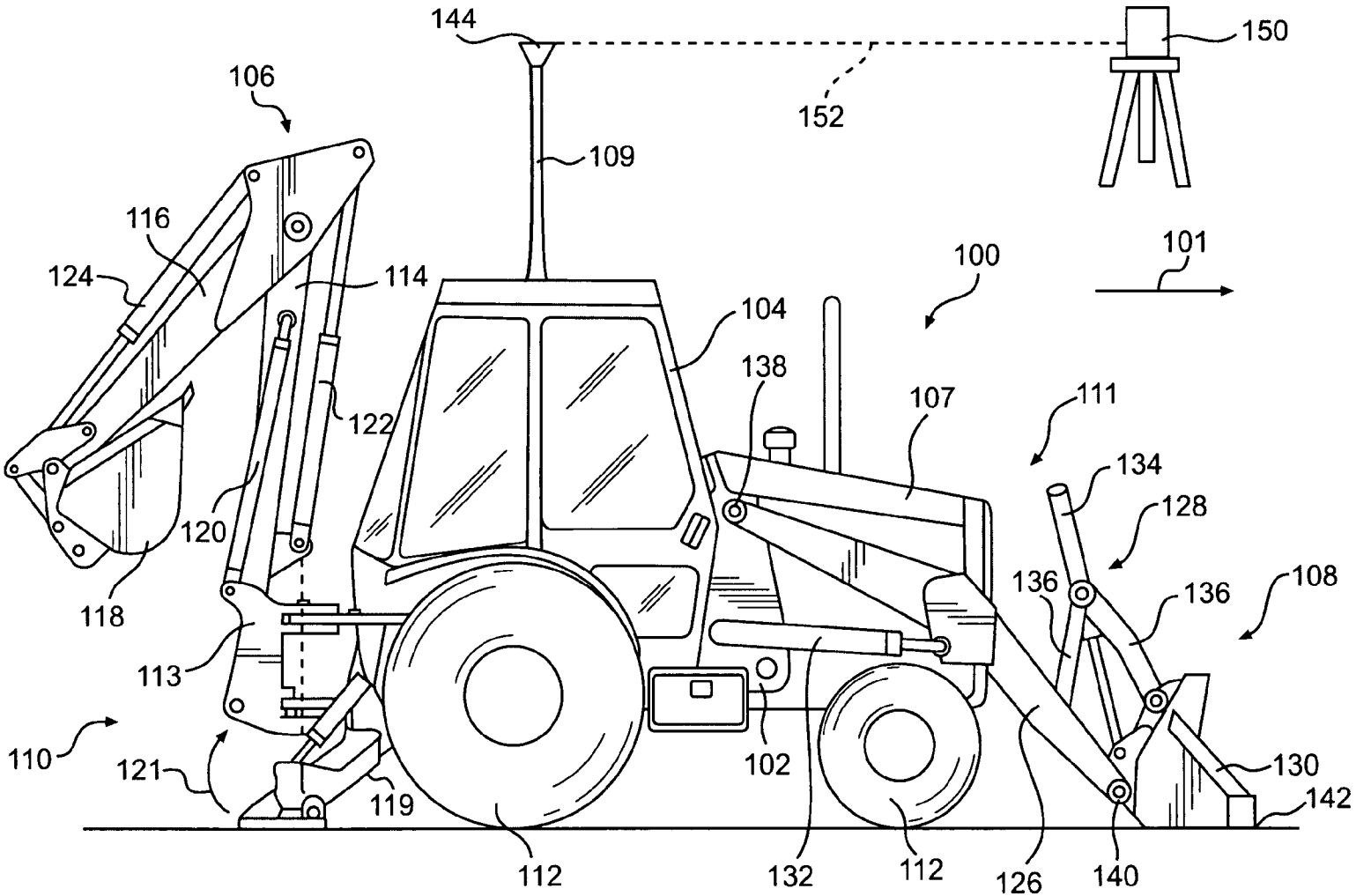
FIG. 1 is a diagrammatic side view of an exemplary embodiment of a backhoe loader.

An exemplary embodiment of a backhoe loader 100 is illustrated in FIG. 1. Although this disclosure describes and references the backhoe loader 100, the systems and methods described herein could be equally applicable and useable by any loader type work machine including, for example, a wheel loader and a track loader. In the exemplary embodiment shown, the backhoe loader 100 includes a frame structure 102, an operator's station 104, a rear digging assembly 106, a front loader assembly 108, an engine compartment 107, and a laser mast 109. The rear digging assembly 106 and the front loader assembly 108 are supported by the frame structure 102 at a rear end 110 and a front end 111, respectively, of the backhoe loader 100.

The backhoe loader 100 further includes wheels 112 for supporting the backhoe loader 100. In addition, the wheels 112 may be used to propel the backhoe loader 100 over the ground. Although the backhoe loader 100 is disclosed with wheels 112, it may instead include a track or other supporting and propelling system.

The operator's station 104 may be supported on the frame structure 102 and may be open or an enclosed compartment. Controls may be associated with the operator's station 104 and may include, for example, one or more input devices for operating and/or driving the backhoe loader 100. In one exemplary embodiment, the controls may also include one or more displays for conveying information to an operator.

The rear digging assembly 106 may include a swing frame 113, a boom member 114, a stick member 116, and a rear work implement 118. In one exemplary embodiment, the stick member 116 is an extendable stick. The digging assembly 106 can be used, for example, to dig a hole or ditch, level the ground, or grade an area at a desired slope. The swing frame 113 may be connected to and supported by the frame structure 102. The boom member 114 may extend between the swing frame 113 and the stick member 116. The stick member 116 may extend from the boom member 114 to the work implement 118. The work implement 118 may be connected to an end of the stick member 116. The work implement 118 may be, for example, a bucket or shovel for picking up and moving dirt and soil, but may be any other implement, as would be apparent to one skilled in the relevant art. Stabilizers, one of which is illustrated as element 119, may be deployed to ground contact during use of rear digging assembly 106. may extend between the swing frame 113 and the stick member 116. The stick member 116 may extend from the boom member 114 to the work implement 118. The work implement 118 may be connected to an end of the stick member 116. The work implement 118 may be, for example, a bucket or shovel for picking up and moving dirt and soil, but may be any other implement, as would be apparent to one skilled in the relevant art.

A boom actuator 120, a stick actuator 122, a rear work implement actuator 124, and a swing frame actuator (not shown) may be associated with the rear digging assembly 106 to manipulate and operate the rear digging assembly 106 to perform any of a variety of tasks in a manner known in the art. The actuators 120, 122, 124 may be hydraulic powered cylinders, but also may be other types of actuators as would be apparent to one skilled in the art. The front loader assembly 108 may connect to and be supported by the frame structure 102. Connected to and extending from the front end 111 of the backhoe loader 100, the front loader assembly 108 may include a loader boom 126, a tilt mechanism 128, and a front work implement, such as the loader bucket 130. Although this disclosure describes the front work implement as the loader bucket 130, the front work implement could be another tool, such as, for example, a shovel for picking up and moving dirt and soil, a blade, a cutting implement, or other implement known in the art. In addition, the front loader assembly 108 may include a lift actuator 132 and a tilt actuator 134 for raising the loader boom 126 and tilting the loader bucket 130.

The loader boom 126 may extend from the frame structure 102 to the loader bucket 130. Accordingly, the loader boom 126 may be operable to raise and lower the loader bucket 130. The loader boom 126 and the frame structure 102 may connect at a loader joint 138 and the loader bucket 130 and the loader boom 126 may connect at bucket joint 140. These joints 138, 140 may be pin joints, allowing the respective loader boom 126 and loader bucket 130 to pivot so that the tilt of the loader bucket 130 can be controlled.

The tilt mechanism 128 may include one or more links 136 operable to tilt the loader bucket 130. The tilt actuator 134 may be a part of or associated with the tilt mechanism 128 and may provide power to the tilt mechanism 128. It should be noted that in some exemplary embodiments, the tilt actuator 134 connects directly to the loader boom 126 and the loader bucket 130, thereby allowing the tilt actuator 134 to directly tilt the loader bucket 130.

The loader bucket 130 may be a bucket configured to receive, scoop, and/or carry a load. It may also be used in grading tasks to grade a worksite. The loader bucket 130 may include a leading edge 142 that may be a known distance from the loader bucket joint 140.

The laser mast 109 may extend upward from the backhoe loader 100. In this embodiment, the laser mast 109 extends upwardly from a top of the operator's station 104. However, the laser mast 109 may extend upwardly from any position that is fixed relative to the frame structure 102, including, for example, from an engine compartment 107 or the frame structure 102. In one exemplary embodiment, the laser mast 112 extends upwardly from a location at one side of the engine compartment 107, and in another, from a location on the frame structure 102 disposed behind the operator's station 104, adjacent the rear digging assembly 106.

In another exemplary embodiment, the laser mast 109 extends from the loader bucket 130 itself. Although FIG. 1 shows only a single laser mast 109, the backhoe loader 100 may include more than one laser mast 109. In such an embodiment, the laser masts may be disposed at any appropriate place on the backhoe loader, including on each end of the loader bucket 130. Alternatively, one laser mast may extend upward from an end of the loader bucket 130 while another mast may extend up from a middle portion of the loader bucket 130. It should be noted that the laser masts may be placed at other locations about the backhoe loader 100.

The laser mast 109 may include a laser receiver 144 disposed thereon. The laser receiver 144 may include a plurality of linearly aligned photo receptors and associated circuitry (not shown) for delivering an output signal representative of the particular receptor illuminated. The laser mast 109 may be configured to extend and retract to change the height of the laser receiver 144 to track a laser plane. Accordingly, as the backhoe loader 100 moves across the worksite, in the direction of arrow 101, for example, the laser mast 109 may maintain the laser receiver 144 in line with the laser plane despite elevational changes of the backhoe loader 100. By detecting the laser plane, the laser receiver 144 may be configured to monitor the height of the backhoe loader 100 relative to the laser plane. Based upon the sensed laser plane, the laser receiver 144 may also be configured to communicate a height signal indicative of the height of the backhoe loader 100.

Figure 2:
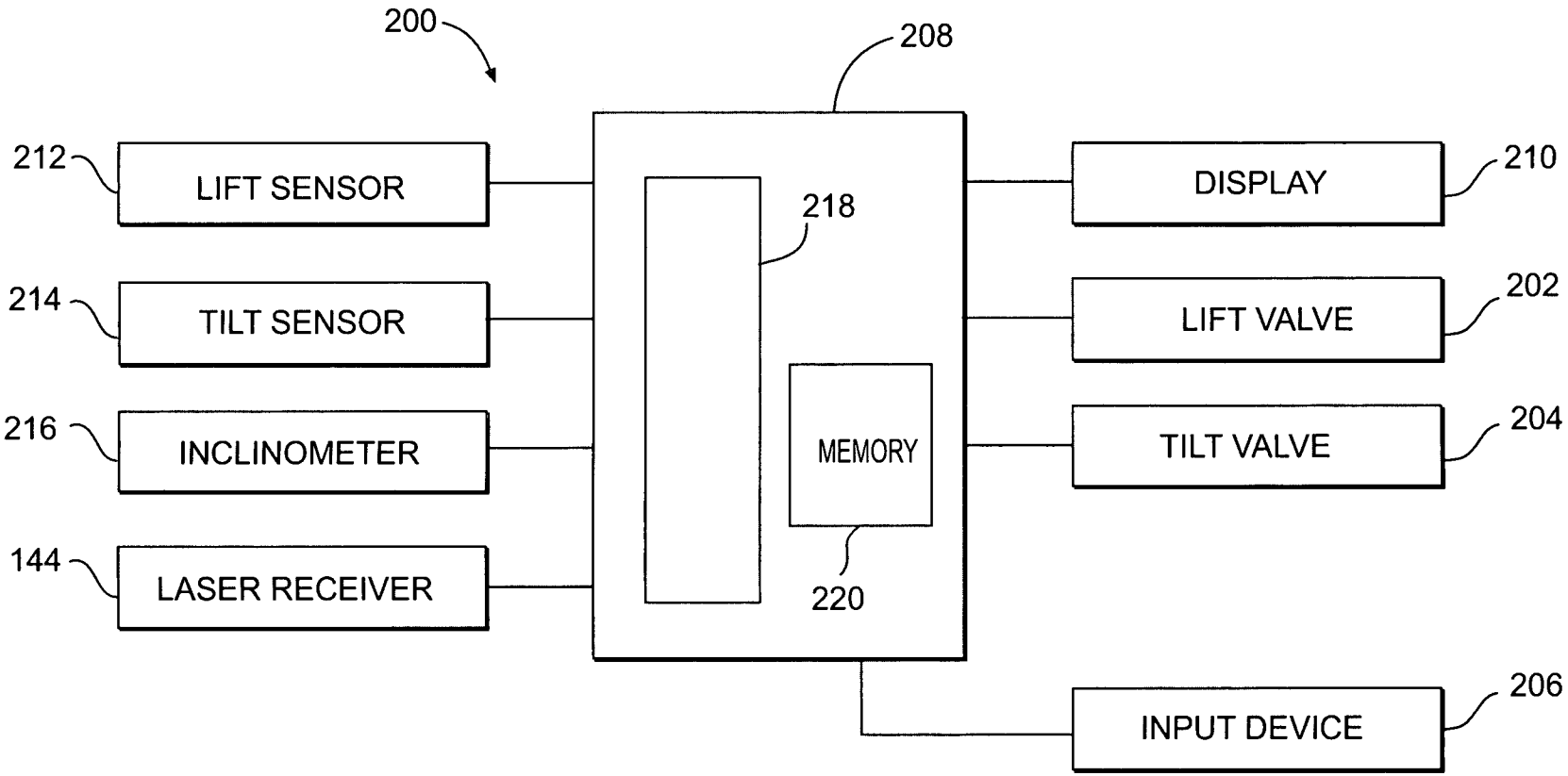
FIG. 2 is a block diagram of an exemplary control system.

Hydraulic actuator valves, shown in FIG. 2, may control the extension and retraction of the lift and tilt actuators 132, 134. A lift valve 202 may be associated with the lift actuator 132 and a tilt valve 204 may be associated with the tilt actuator 134. The valves 202, 204 may be controlled to coordinate the flow of hydraulic fluid to control the rate and direction of movement of the associated lift and tilt actuators 132, 134. It should be noted that the term "extension amount" represents both the amount of extension or retraction of the actuators 132, 134.

As shown in FIG. 1, a laser generator 150 may be configured to deliver a low intensity laser beam 152 that may be swept over a worksite to define a laser plane (not shown). The laser generator 150 may be positioned at a preselected coordinate location ("x", "y") within the worksite. The laser beam 152 may define the laser plane above the worksite at a predetermined elevational position, with the laser plane being substantially parallel to a desired worksite grade. The distance between the laser plane and the desired grade may thereby establish an elevational coordinate position "z".

FIG. 2 shows an exemplary control system 200 for controlling the position of the loader bucket 130 relative to the generated laser plane. As described in greater detail below, the control system 200 may be configured to determine and/or move the loader bucket 130 while grading a worksite so that the finished grade substantially corresponds to the desired grade, as defined by the laser plane.

The control system 200 may include an input device 206, a control module 208, a display 210, and one or more sensors that provide measured inputs. In one exemplary embodiment, the sensors may include a lift sensor 212, a tilt sensor 214, an inclinometer 216, and the laser receiver 144. Using information gathered by one or more of the sensors, the control system 200 may control the position and movement of the lift and tilt actuators 132, 134 on the backhoe loader 100 to maintain the loader bucket 130 along the desired grade.

The input device 206 could be one or more joysticks, keyboards, levers, or other input devices known in the art. Adapted to generate a desired movement signal, the input device 206 may receive an input from an operator and communicate the input as a signal to the control module 208. The input device 206 may be used to operate or drive the backhoe loader 100 and may also be used to manually control the lift and/or tilt actuators 132, 134.

The control module 208 may include a processor 218 and a memory device 220. The memory device 220 may store one or more control routines, which could be software programs, for determining a position of the loader bucket 130 relative to the laser plane and/or the desired grade and for controlling the front loader assembly 108 based on the determined position. The processor 218 may receive the input signal from the input device 206 and may execute the routines to generate and deliver a command signal to control the actuator valves 202, 204 that are associated with the lift and tilt actuators 132, 134.

The lift sensor 212 may be associated with the lift actuator 132, and the tilt sensor 214 may be associated with the tilt actuator 134. The lift and tilt sensors 212, 214 may be configured to provide information indicative of the position of the loader bucket 130. In one exemplary embodiment, the lift and tilt sensors 212, 214 are in-cylinder position sensors configured to measure an extension amount of the lift and tilt actuators 132, 134. In another exemplary embodiment, the lift and tilt sensors 212, 214 are rotary sensors associated with the front loader assembly 130 at the joints 138, 140 in FIG. 1. The lift and tilt sensors 212, 214 may be in communication with the control module 208 and may provide signals to the control module 208 indicative of the sensed parameter.

Using the extension amounts of the actuators 132, 134 and/or by measuring the angles at the joints 138, 140, the control module 208 may be configured to use trigonometric and/or kinematic equations to determine the position of the loader bucket 130 relative to the backhoe loader 100. In one exemplary embodiment, the control module 208 is configured to determine the location of the leading edge 142 of the loader bucket 130. The control module 208 may monitor one or more of the lift and tilt sensors 212, 214 at a single time, but does not need to monitor both of them at the same time.

The inclinometer 216 may be associated with the backhoe loader 100 and may be configured to monitor and determine inclination of the backhoe loader 100, in any direction, including the pitch and roll directions. The pitch may be the front to back rotation and the roll may be the side to side rotation. In one embodiment, the inclinometer 216 is disposed on the frame structure 102. In another exemplary embodiment, the inclinometer is disposed on the loader bucket 130. It should be noted, however, the inclinometer 216 may be disposed on the backhoe loader 100 at any location that may be representative of the tilt or roll of the backhoe loader 100 and/or the loader bucket 130.

The laser receiver 144 may be associated with the control module 208 and may be configured to monitor the height of the backhoe loader 100 relative to the laser plane. The laser receiver may also be configured to communicate a signal indicative of the height to the control module 208.

The control module 208 may use the information received from the lift sensor 212, the tilt sensor 214, the inclinometer 216, and the laser receiver 144 to determine the position of the loader bucket 130 relative to the laser plane and/or the desired grade. In one exemplary embodiment, the control module 208 is configured to determine the position of the leading edge 142 of the loader bucket 130 relative to the laser plane and/or the desired grade.

In addition, the control module 208 may be configured to determine the distance or amount of movement required so that the loader bucket 130 is disposed at a height that substantially corresponds to the desired grade. Based on this information, the control module 208 may be configured to generate a valve control signal to control the lift and tilt valves 202, 204 to move the lift and tilt actuators 132, 134 so that the loader bucket 130 substantially follows the desired grade. Accordingly, while an operator drives the backhoe loader 100 across the worksite, the control module 208 may be configured to automatically control the height and tilt of the loader bucket 130 to grade the worksite, thereby minimizing the effort and control by the operator. This may simplify grading with the backhoe loader 100 and may increase the accuracy of the grade.

It should be noted that in one exemplary embodiment, an operator may input a command through the input device 206 to selectively operate the control module 208 to discard or not consider the tilt signal during its computations. Accordingly, in this embodiment, the control module 208 may be configured to control the height of the loader bucket 130 relative to the desired grade without controlling or monitoring the tilt.

The display 210 may also be associated with the control module 208 and may be configured to present information for viewing by the operator. The display 210 may be positioned on the backhoe loader 100 for viewing from the operator's station 104. Therefore, the operator may view the display 210 while operating the backhoe loader 100. In one exemplary embodiment, the information is sent to the display 210 as a display signal from the control module 208. The display signal may include information indicative of the position of the loader bucket 130 relative to the laser plane and/or the desired grade. Accordingly, an operator of the backhoe loader 100 may view the display 210 while operating the backhoe loader 100 and have an indication of the position of the loader bucket 130 relative to the desired grade.

In one exemplary embodiment, the display 210 may show the position of the loader bucket 130 as x, y, z coordinates. In another exemplary embodiment, the display 210 includes a series of LED lights that indicate whether the loader bucket 130 is above grade, on grade, or below grade. In one exemplary embodiment, instead of a visual display, the control module 208 is associated with an audible indicator configured to indicate whether the loader bucket 130 is above grade, on grade, or below grade. In yet another exemplary embodiment, the control module 208 is associated with both the display 210 and the audible indicator.

INDUSTRIAL APPLICABILITY

The control system 200 described herein may simplify the process of grading a worksite with a work machine, such as the backhoe loader 100, a wheel loader, a front end loader, or other work machine. Loaders are widely used service machines that may accomplish any number of tasks, including grading. Because of their size, loaders may be used to grade worksites that may not be easily graded with a motor grader or bulldozer tractor.

Use of the control system 200 may ease the task of grading by automatically controlling the loader bucket 130 to be on grade. In addition, the control system 200 may reduce the reliance on external personnel, such as surveyors, who may otherwise be required to monitor grading and/or digging progress to ensure that the grade is within acceptable limits. Furthermore, because the system relies upon a laser as a reference point, it may reduce or eliminate the need for grade stakes, yet may still provide a more accurate system than can be achieved with grade stakes because the laser is equivalent to an infinite number of reference points.

The control system 200 may determine the location of the loader bucket 130, including the location of the leading edge 142, relative to the desired grade. The desired grade may be defined by the laser plane generated above the worksite. In one embodiment, the laser plane is established to be substantially parallel to the desired grade, but offset from the desired grade by a known height. By determining the location of the loader bucket 130 relative to the desired grade, the loader bucket 130 can be controlled to be maintained on grade, increasing the accuracy of the final grade.

Figure 3:
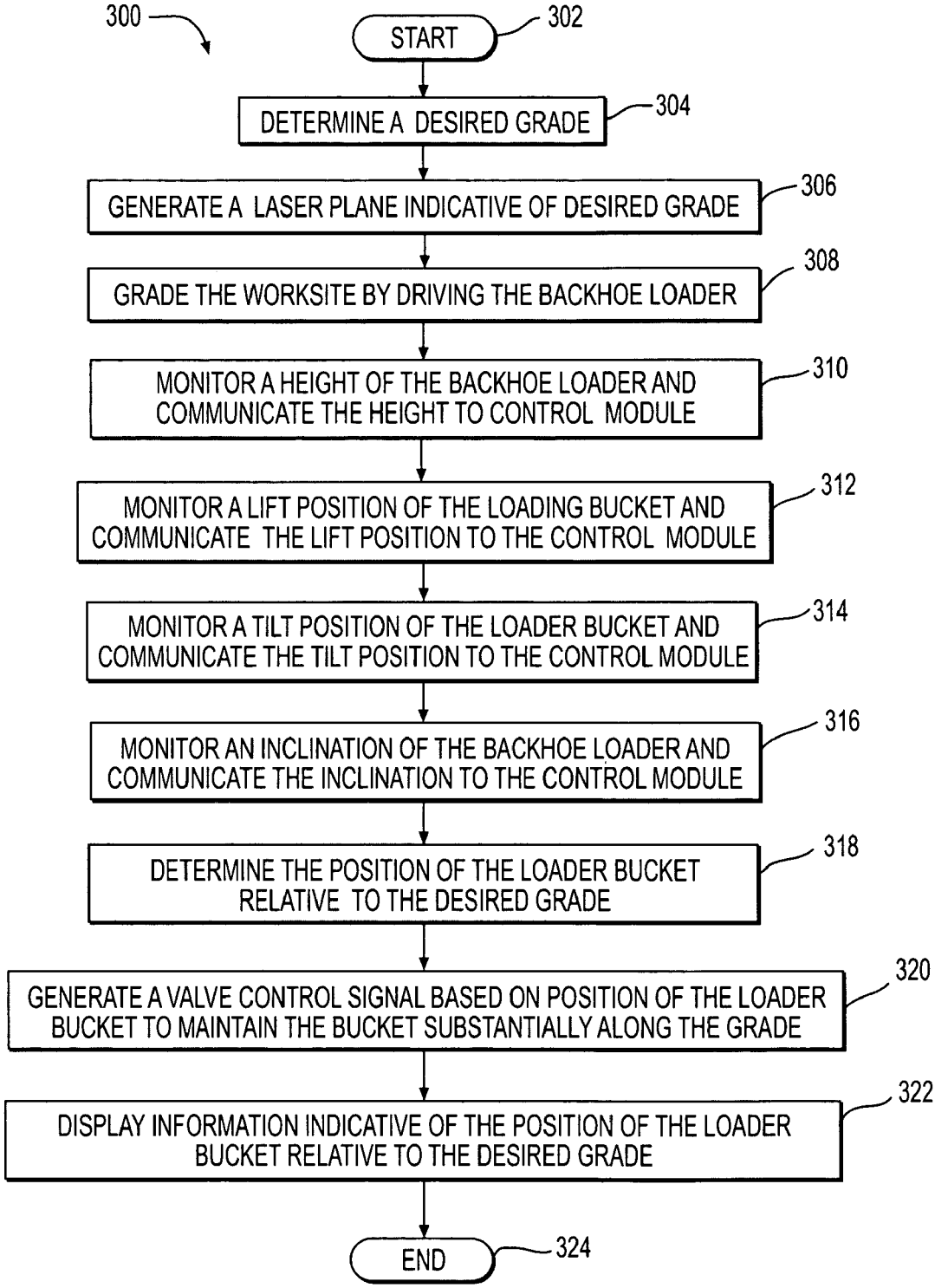
FIG. 3 is a flow chart showing an exemplary method of controlling a position of a loader bucket on a backhoe loader.

FIG. 3 shows an exemplary method 300 of grading a worksite with the backhoe loader 100. The method begins at a start step 302. At a step 304, a desired grade is determined. The desired grade may be worksite specific and may be called out on blueprints. At a step 306, a laser plane is generated over the worksite that is indicative of the desired grade. Generated by the laser plane generator 150, the laser plane may be emitted substantially parallel to, and a known distance above, the desired grade. Therefore, the laser plane may be used as a reference to define the height of the backhoe loader 100 relative to the laser plane. At a step 308, an operator drives the backhoe loader 100 across the worksite, using the loader bucket 130 to grade the worksite. Stabilizer 119 is, of course, retracted from around contact when using loader bucket 130 to grade the worksite, as graphically indicated by arrow 121 in FIG. 1.

At a step 310, the height of the backhoe loader 100 relative to the laser plane is monitored by the laser receiver 144. As stated above, the laser receiver is attached to the backhoe loader 100 and may be disposed on the laser mast 109. A height signal, indicative of the height of the backhoe loader relative to the laser plane, may be communicated from the laser receiver to the control module 208.

At a step 312, the lift sensor 212 monitors a lift position of the loader bucket 130 and communicates a lift signal indicative of the lift position to the control module 208. At a step 314, the tilt sensor 214 monitors a tilt position of the loader bucket 130. The tilt sensor 214 may communicate a tilt signal indicative of the tilt position to the control module 208. The tilt and lift signals are indicative of the position of the loader bucket 130 relative to the backhoe loader 100.

At a step 316, an inclination of the backhoe loader 100 is monitored with the inclinometer 216. The inclinometer 216 may communicate an incline signal indicative of the inclined position to the control module 208. The incline signal is indicative of the pitch or roll of the backhoe loader 100 and/or the loader bucket 130 and allows for compensation in determining the position of the backhoe loader 100 relative to the laser plane and/or the desired grade.

The control module 208 may receive the height signal, the tilt signal, the lift signal, and the incline signal and, based upon these signals, may determine the position of the loader bucket 130 relative to the laser plane and/or the desired grade, at a step 318. As stated above, the laser plane is indicative of the desired grade, the height signal is indicative of the backhoe loader height relative to the laser plane, the tilt and lift signals are indicative of the loader bucket position relative to the backhoe loader 100, and the incline signal allows compensation for pitch or roll of the backhoe loader 100. Based upon one or more of these signals, and using stored trigonometric and/or kinematic equations or processes, the control module 208 may determine the position of the loader bucket 130 relative to the desired grade.

At a step 320, the control module 208 may generate a valve control signal that may be communicated to the lift and tilt valves 202, 204. The valve control signal may be a command signal that operates one or more of the valves 202, 204 to extend or retract the respective lift and tilt actuators 132, 134. The valve control signal, therefore, may operate the valves 202, 204 to move or to maintain the loader bucket 130 at a position corresponding to the desired grade. Thus, the backhoe loader 100 may grade the worksite at the desired grade without manual input from the operator.

At a step 322, the control module 208 may also generate and communicate a display signal to the display 210. The display signal may include information indicative of the position of the loader bucket 130, or a portion of the loader bucket 130, relative to the desired grade. Accordingly, based upon the information, the display 210 may show information indicative of the position of the loader bucket 130 relative to either the laser plane and/or the desired grade. The method ends at a step 324.

The system and method described herein provide control of the loader bucket 130 of the backhoe loader 100 during a grading process. Because the position of the loader bucket 130 is automatically monitored and controlled, reliance on manual input from an operator is reduced. This may reduce operator fatigue while maintaining an accurate grade. Furthermore, this may reduce the reliance on additional manpower, such as surveyors, who may otherwise be required to monitor grading progress to ensure the grade is within acceptable limits. Although the system is disclosed as being used on a backhoe loader, the system may be equally applicable to a front-end loader, wheel loader, or other appropriate work machine. In addition, although the front work implement is described as a loader bucket, it could be, for example, a blade, shovel, or any other suitable implement.

It will be apparent to those skilled in the art that various modifications and variations can be made in the disclosed embodiments without departing from the scope of the invention. Other embodiments of the invention will be apparent to those skilled in the art from consideration of the specification and practice of the invention disclosed herein. It is intended that the specification and examples be considered as exemplary only, with a true scope of the invention being indicated by the following claims and their equivalents.

What is claimed is:

1. A grading control system for a machine including a work implement for grading as the machine is propelled about a work site and along a grade defined by a laser plane generator, comprising:

a tilt actuator associated with the work implement and configured to tilt the work implement;

a lift actuator configured to selectively raise and lower the work implement;

a laser receiver configured to receive a laser signal from the laser plane generator indicative of a desired grade, the laser receiver being configured to communicate a height signal based on the laser signal, the height signal being indicative of a position of the machine or work implement relative to the laser plane;

a lift sensor configured to communicate a lift signal indicative of a lift position of the work implement;

a tilt sensor configured to monitor a tilt position of the work implement and configured to communicate a tilt signal; and a control module in communication with the laser receiver, the lift sensor, and the tilt sensor, the control module being configured to generate a control signal based on the height signal, the lift signal, and the tilt signal, and also being configured to communicate the control signal to actuate at least one of the lift and tilt actuators to maintain the work implement at a position substantially corresponding to the desired grade as the machine is propelled about a work site.

2. The grading control system of claim 1, wherein at least one of the tilt and lift sensors is respectively associated with the tilt and lift actuators and configured to communicate an extension amount of the respective actuators.

3. The grading control system of claim 2, wherein at least one of the tilt and lift sensors is an in-cylinder position sensor.

4. The grading control system of claim 1, wherein the machine includes pivot joints that support the work implement, wherein at least one of the tilt and lift sensors is an angle sensor disposed at one of the pivot joints.

5. The grading control system of claim 1, including a tilt valve and a lift valve associated with the tilt and lift actuators, respectively, wherein the control module is configured to communicate the control signal to the tilt and lift valves to actuate the lift and tilt actuators.

6. The grading control system of claim 1, further including an inclinometer associated with the machine to monitor the incline of the machine and configured to communicate an incline signal to the control module, the control module being configured to generate the control signal at least partially based on the incline signal.

7. The grading control system of claim 6, wherein the inclinometer is configured to monitor both a pitch and a roll of the machine.

8. The grading control system of claim 1, including a laser mast associated with and extending upwardly from the work implement, the laser receiver being disposed on the laser mast and being configured to communicate the height of the work implement to the control module.

9. The grading control system of claim 1, including a laser mast associated with and extending upwardly from a location fixed relative to a frame structure of the machine, the laser receiver being disposed on the laser mast and being configured to communicate the height of the machine to the control module.

10. The grading control system of claim 9, wherein the height of the laser receiver is automatically controlled to correspond to the height of a laser plane as the machine moves about a work site.

11. The grading control system of claim 1, including a display system in communication with the control module, the control module being configured to communicate display information to the display system regarding the position of the work implement relative to the desired grade.

12. A machine having a front end and a back end, comprising:

a work implement for grading as the machine is propelled about a work site and along a grade defined by a laser plane generator; and a grading control system including a tilt actuator associated with the work implement and configured to tilt the work implement;

a lift actuator configured to selectively raise and lower the work implement;

a laser receiver configured to receive a laser signal from the laser plane generator indicative of a desired grade, the laser receiver being configured to communicate a height signal based on the laser signal, the height signal being indicative of a position of the machine or work implement relative to the laser plane;

a lift sensor configured to communicate a lift signal indicative of a lift position of the work implement;

a tilt sensor configured to monitor a tilt position of the work implement and configured to communicate a tilt signal; and a control module in communication with the laser receiver, the lift sensor, and the tilt sensor, the control module being configured to generate a control signal based on the height signal, the lift signal, and the tilt sensor, and also being configured to communicate the control signal to actuate at least one of the lift and tilt actuators to maintain the work implement at a position substantially corresponding to the desired grade as the machine is propelled about a work site;

wherein the work implement is disposed at the front end of the machine.

13. The machine of claim 12, including a digging assembly disposed at a rear end of the machine, wherein the digging assembly includes a boom, a stick, and a rear work implement.

14. The machine of claim 13, wherein the stick is an extendable stick.

15. The machine of claim 12, including a tilt valve and a lift valve associated with the tilt and lift actuators, respectively, wherein the control module is configured to communicate the control signal to the tilt and lift valves to actuate the tilt and lift actuators.

16. The machine of claim 12, including a laser mast associated with and extending upwardly from the work implement, the laser receiver being disposed on the laser mast.

17. The machine of claim 16, including a second laser mast extending upward from the work implement, wherein the second laser mast includes a second laser receiver disposed thereon.

18. The machine of claim 12, including a laser mast associated with and extending upwardly from a location fixed relative to a frame structure of the machine, the laser receiver being disposed on the laser mast.

19. The machine of claim 18, wherein the height of the laser receiver is automatically controlled to correspond to the height of a laser plane as the machine moves about a work site.

20. A method of grading using a machine having a work implement, including a tilt actuator and a lift actuator, for grading along a grade defined by a laser plane generator, the method comprising:

generating a laser plane indicative of a desired grade;

propelling the machine about a work site;

detecting the laser plane at a laser receiver;

communicating a height signal based on the laser plane from the laser receiver, the height signal being indicative of a position of the machine relative to the laser plane;

communicating a lift signal indicative of a lift position of the work implement with a lift sensor;

communicating a tilt signal indicative of a tilt position of the work implement to a control module;

generating a control signal with the control module, the control signal being based on the height signal, the lift signal, and the tilt signal; and communicating the control signal to at least one of the lift actuator and the tilt actuator to maintain a position of the work implement at a desired height relative to the desired grade as the machine is propelled about the work site.

21. The method of claim 20, including communicating the control signal to at least one of a tilt valve and a lift valve associated with the tilt and lift actuators, respectively.

22. The method of claim 20, further including:

communicating an incline signal indicative of an inclination of the machine to the control module; and generating the control signal at least partially based on the incline signal.

23. The method of claim 20, including automatically raising and lowering the laser receiver with a laser mast while the machine moves about a worksite.

24. The method of claim 20, including displaying information regarding the position of the work implement relative to the desired grade.

25. A machine, comprising:

a frame structure;

a ground supporting and propelling system on the frame structure;

a front loader assembly supported by the frame structure, including a front work implement, a tilt actuator configured to tilt the front work implement, a lift actuator configured to selectively raise and lower the front work implement, a lift sensor configured to communicate a lift signal indicative of a lift position of the front work implement, and a tilt sensor configured to communicate a tilt signal indicative of a tilt position of the front work implement;

a laser mast extending upward from a position fixed relative to the frame structure;

a laser receiver disposed on the laser mast and configured to receive a laser signal of a laser plane indicative of a desired grade, the laser receiver being configured to communicate a height signal based on the laser signal, the height signal being indicative of a position of the machine relative to the laser plane; and a control module in communication with the laser receiver, the lift sensor, and the tilt sensor, the control module being configured to generate a control signal based on the height signal, the lift signal, and the tilt sensor, and also being configured to communicate the control signal to actuate the lift and tilt actuators to maintain the front work implement at a position substantially corresponding to the desired grade as the machine moves about a work site.

26. The machine of claim 25, further including an inclinometer associated with the machine to monitor the incline of the machine and configured to communicate an incline signal to the control module, the control module being configured to generate the control signal at least partially based on the incline signal.

* * * * *

UNITED STATES PATENT AND TRADEMARK OFFICE

CERTIFICATE OF CORRECTION

PATENT NO. : 7,293,376 B2
APPLICATION NO. : 10/994233
DATED : November 13, 2007
INVENTOR(S) : Glover It is certified that error appears in the above-identified patent and that said Letters Patent is hereby corrected as shown below:

In Column 7, Line 48, delete "around" and insert -- ground --, therefor.

Signed and Sealed this

Eighth Day of December, 2009

David J. Kappos

David J. Kappos
*Director of the United States Patent and Trademark Office*